United States Patent [19]

Mylenek

[11] 3,947,159

[45] Mar. 30, 1976

[54] SPLIT BEARING FOR WANKEL ENGINE

[75] Inventor: Ray A. Mylenek, Royal Oak, Mich.

[73] Assignee: Ford Motor Company, Dearborn, Mich.

[22] Filed: Aug. 6, 1974

[21] Appl. No.: 495,692

[52] U.S. Cl. ..... 418/60; 418/83; 418/94; 418/212

[51] Int. Cl.[2] ..... F01C 21/02; F01C 21/04

[58] Field of Search ..... 418/60, 83, 212; 123/8.07; 184/31

[56] References Cited

UNITED STATES PATENTS

| | | | |
|---|---|---|---|
| 3,062,435 | 11/1962 | Bentele | 418/60 |
| 3,096,746 | 7/1963 | Sollinger | 123/8.07 |
| 3,193,187 | 7/1965 | Jones et al. | 418/60 |
| 3,259,115 | 7/1966 | Bensinger et al. | 418/212 X |

*Primary Examiner*—C. J. Husar
*Assistant Examiner*—Leonard Smith
*Attorney, Agent, or Firm*—Joseph W. Malleck; Keith L. Zerschling

[57] ABSTRACT

A multi-rotor Wankel type rotary engine is disclosed having an intermediate or center bearing assembly for the eccentric shaft in addition to end bearing assemblies. The center bearing is split along a central plane for special assembly techniques. The indermediate housing, receiving the center bearing, is substantially hollow and has a sector interrupting the hollow interior to act as a support for one of the split portions of the center bearing. The portions are joined to the sector by a pair of bolts extending only through the sector and split bearing portions.

4 Claims, 4 Drawing Figures

SPLIT BEARING FOR WANKEL ENGINE

BACKGROUND OF THE INVENTION

In rotary internal combustion engines incorporating more than one rotor along a common eccentric shaft, the problem of supporting the eccentric shaft within the engine housing becomes more acute. Typically the eccentric shaft has been supported solely by main bearings stationed at opposite ends of the shaft. This has served satisfactorily in connection with single rotor engines since the loading arm is inadequate to seriously deflect the center of the eccentric shaft. However, as the number of rotors is increased, assembly becomes difficult and the loading arm increases with the opportunity for slight deflection in the mid region of the eccentric shaft. Since the sealing efficiency of the engine and consequent engine efficiency is dependent on close tolerances, such deflection is highly undersirable.

One approach to preventing such deflection has been to split the eccentric shaft and support each split portion with opposite end main bearings. This, of course, complicates the engine construction and promotes problems of main bearing lubrication and excess weight. Another approach by the prior art is to incorporate a center bearing in addition to the end bearings. This latter suggestion has not become a practical reality since it presents immediate problems of interrupting the normal oil flow which traditionally passes through and radially outwardly of the intermediate housing in a multi-rotor engine. If a typical known configuration is used for the intermediate bearing, it is required that it be stationed in place by the use of rods extending through and out of the intermediate housing, the latter interrupting not only the oil cooling circuit but also the water cooling circuit.

SUMMARY OF THE INVENTION

A primary object of this invention is to provide a bearing assembly for the eccentric shaft of a multi-rotor Wankel type internal combustion engine, the improved assembly being capable of providing adequate support for the eccentric shaft while at the same time providing minimal interference with the oil flow and drainage through the housings supporting the various bearing assemblies.

Another object of this invention is to provide a rotary internal combustion engine having a bearing assembly for the eccentric shaft of a multi-rotor engine wherein the mode of assembly of intermediate bearings is simplified and the cost of fabricating the engine is decreased.

Specific features pursuant to the above objects comprise; (*a*) the combination of a bearing and stationary gear (the latter serving as a timing element for the rotor) in a unitary structure, the structure being split along a central axial plane; (*b*) the attachment of such split structure as an intermediate bearing in steps, first inserting the larger of the split bearing portions into a space opposite from what it will occupy, then inserting the smaller of the split bearing portions, finally rotating the mated portions into a proper oriented position for being keyed and locked in position; the attachment of the split center bearing is to a housing sector which extends along an arc of less than 100°. The intermediate housing has channels for facilitating continuous 360° oil drainage.

DETAILED DESCRIPTION

Figure 1:
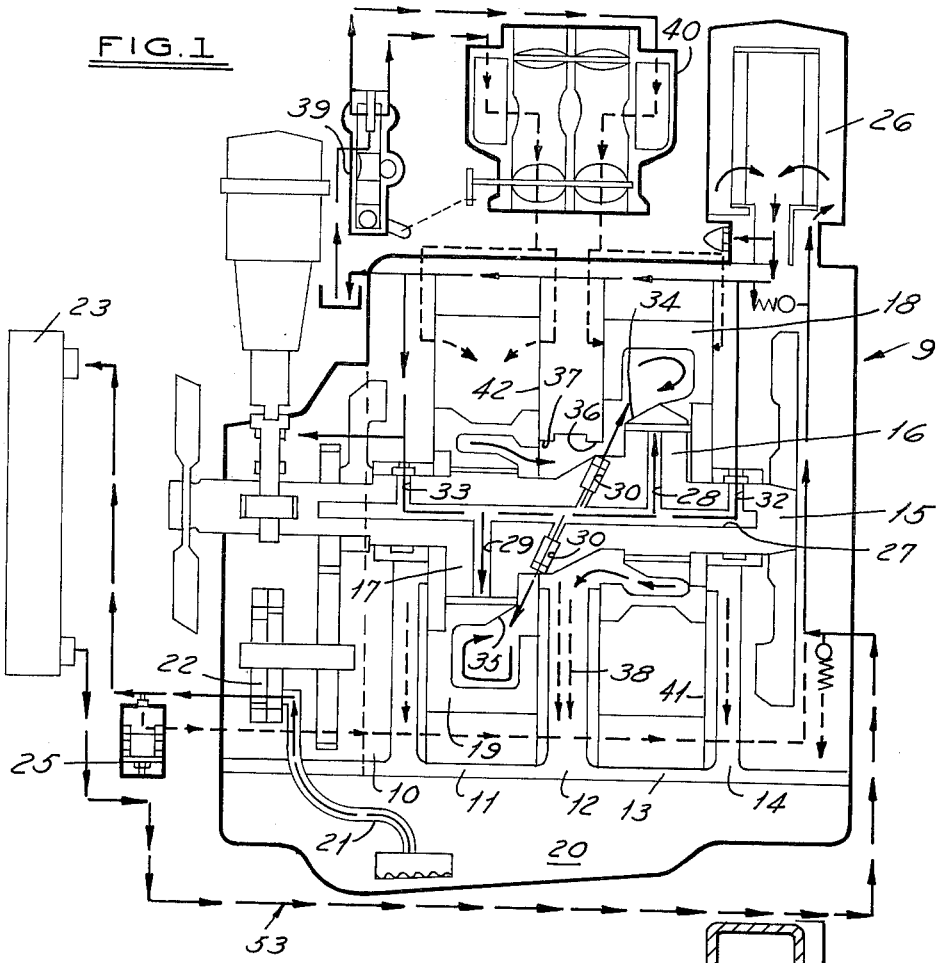
FIG. 1 is a schematic layout of a rotary internal combustion engine according to the prior art and illustrating the type of oil lubricating circuit used with this invention; the sketch illustrates in heavy line the outline of the engine and other parts in narrower line (there is shown an eccentric shaft for the multi-rotor engine which does not incorporate the features of this invention but rather has only main bearings disposed at opposite ends of the eccentric shaft)

Turning to FIG. 1, there is illustrated a schematic layout of an oil lubricating circuit for a conventional prior art multi-rotor engine. The engine 9 is comprised of a plurality of housing units: front side housing 10, front rotor housing 11, intermediate housing 12, rear rotor housing 13 and rear side housing 14. The housing units are connected together in side-by-side aligned relationship about an eccentric shaft 15 extending therethrough, the eccentric shaft carrying oppositely arranged eccentrics 16 and 17 for mounting respectively the rotors 18 and 19 thereon.

Oil is drawn from an oil reservoir 20 by way of suction created in passage 21 by an oil pump 22. The pressurized oil is directed to an oil cooler 23 but may be short circuited or bypassed from the cooler by operation of a thermal valve 25 which will direct the oil, if an appropriate temperature exists, directly to the downstream section of the lubricating system. Oil exiting from the oil cooler is directed along with bypassed oil to an oil filter 26 and from there a major portion of the oil is directed to a central bore 27 within the eccentric shaft, the bore extending along substantially the entire length thereof. Radiating ports 28 and 29 (and 32–33) within the eccentric shaft direct high pressure and filtered oil to the bearing sleeves or bushings within the front and rear side housings and to the bearing sleeves or bushings separating the rotors from the eccentrics. In addition, oil is directed on a biased line into scooped out side portions 34 and 35 of each of the rotors so that the contour of the interior of the rotors acts as a slinging mechanism for throwing oil not only around the interior of the rotor but for stimulating a toroidal flow which will throw the oil toward and into the access openings 36 and 37 in the sides of the intermediate housing 12. All of such oil, which is introduced to the various housings and to the various bearing elements of the housings and rotors, drains principally through drain openings (indicated by arrow 38) through the intermediate housing. In some prior art constructions, the front and rear side housings may also have drain openings leading back to the oil reservoir 20.

The other portion of the high pressure oil may be directed to an oil metering pump 39 which sends a portion of the oil for mixing with the combustible mixture introduced through the carburetor 40, where the added oil will facilitate coating the interior trochoid surfaces 41–42 of the respective rotor housings as well as being combusted in a minor amount with the mixture, as a net result of the combustion process.

The important point depicted by the layout of FIG. 1 is that oil flow must proceed to and through the intermediate housing to exit and drain to the oil reservoir. It is at this point that any undue restriction caused by interposition of a center main bearing would be detrimental.

Figure 2:
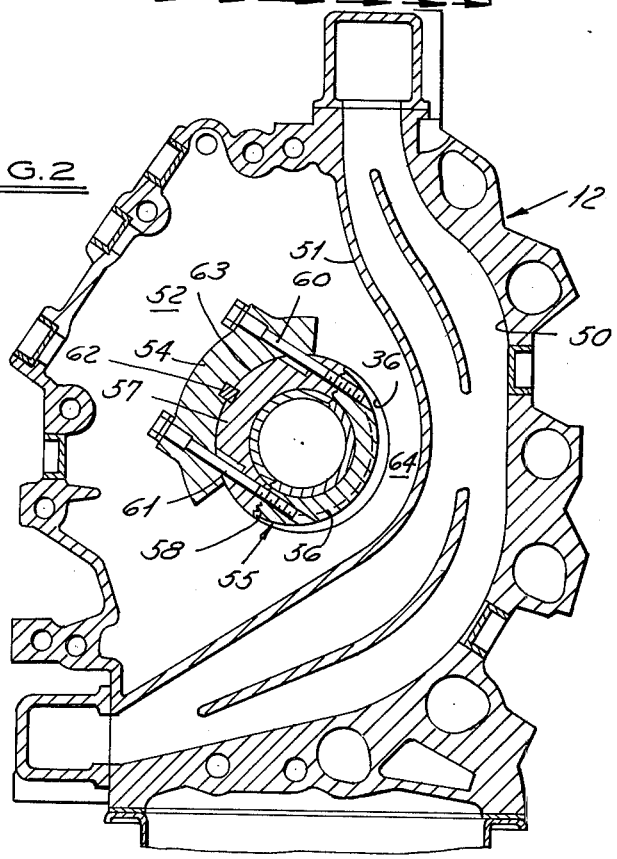
FIG. 2 is a central sectional view of an intermediate housing multi-rotor engine illustrating the center bearing of this invention as installed.

With this in mind, the structure of FIG. 2 has been developed for a center main bearing to support the eccentric shaft 15 in the central region thereof. The intermediate housing 12, as well as all the other housing units of the engine, are constructed with independent water cooling circuits. The water cooling circuit 50 for the intermediate housing is shown extending from an entrance positioned at seven o'clock and extends upwardly flowing and exiting from the housing at a twelve o'clock position. The housing 12 is hollow and has wall 51 separating and cooperating to define the water cooling circuit 50. The remainder of the hollow interior 52 to the other side of wall 51 serves as part of the oil circuit 53.

A crescent shaped housing sector 54 extends between opposite side walls of the intermediate housing and must occupy an arcuate extent less than 100°; the sector has a thickness sufficient to act as a solid support for the bearing but should be as minimal in thickness with that criteria in mind.

The center bearing 55 itself is bipartite having two portions 56 and 57 adapted to mate along a serrated parting plane 58, the plane extending through a diameter of the circular bearing assembly 55.

To assemble the bearing, the intermediate housing 12 is usually placed on its side with the eccentric shaft extending vertically therethrough. The first portion 57, the radially larger of the portions is placed through one of the access openings 36 to reach the interior of the intermediate housing and is stationed opposite from the sector 54. The housing is moved laterally in its own plane toward the larger of the bearing portions causing the sector to move toward the eccentric shaft. Then the second portion 56, which is radially smaller, is inserted through the slightly larger opening available for it and is nested and mated with the larger portion along the serrated surfaces 58; the mated portions are rotated 180° so that the larger portion becomes interengaged with the sector 54. At this point, mounting bolts or screws 60 and 61 are inserted not only through the sector 54 but through both of the portions 56 and 57 of the bearing assembly to provide a rigid support therebetween. A locking key 62 is inserted in grooves defined in both the interior of the sector and the exterior surface 63 of the bearing portion 57.

Oil flow is uninterrupted with this embodiment because of the ability of oil slinging to move the oil inwardly and around the bearing assembly, and about the arcuate configuration of the supporting sector.

Figure 3:
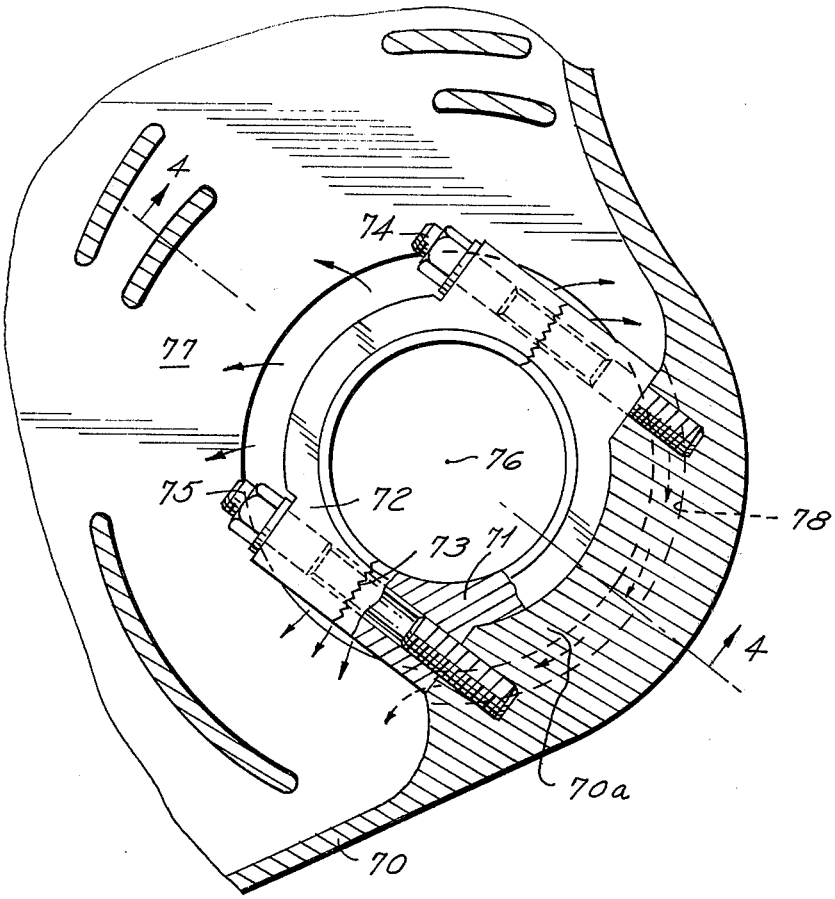
FIG. 3 is an enlarged elevational view of the center main bearing illustrating portions of the housing surrounding said bearing, certain portions of the bearing and housing being broken away to show structure therein.
Figure 4:
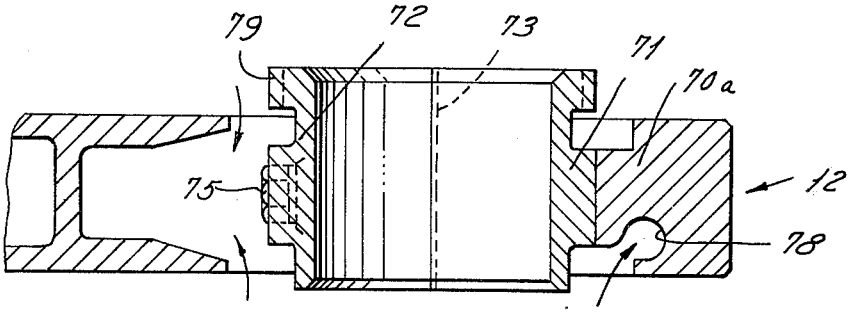
FIG. 4 is a sectional view taken substantially along line 4—4 of FIG. 3.

In FIGS. 3 and 4, an alternative embodiment is shown wherein the supporting sector 70a is solidily connected with the wall 70, defining in part the interior of the water cooling circuit. This cast portion adds rigidity not only to the inner wall of the water cooling circuit but is located at a good mass distribution point for the engine. The wall 70 can aid in cooling the bearing. In essence, the sector is disposed at a location opposite from that disposed in the embodiment of FIG. 2. However, the construction of the split bearing is comparable and similar to that in FIG. 2 with the bearing portions 71 and 72, each carrying a portion of the stationary gear 79, split along a central plane 73 and having serrated mating faces. Aligned openings for mounting bolts 74 and 75 are provided which extend chordally with respect to the centerline 76 of the housing. To permit full 360° circulation of oil through the oil gallery 77 of the intermediate housing, not only to cool the intermediate housing but also to flow outwardly through drain passages thereof, an arcuate passage 78 is defined in the sector 70a to connect remote regions of the oil gallery 77.

I claim as my invention:

1. In a multi-rotor rotary internal combustion engine, the engine having at least two rotor housings and an intermediate housing all in adjacent aligned relationship, an eccentric shaft extending through each of said housings with rotors supported thereon for planetary movement within each of said rotor housings, the combination comprising:

a. an intermediate housing having at least a peripheral end wall and side walls defining a hollow interior, said walls having access openings through which said shaft extends, an integral crescent mounting sector extending between opposite side walls and interrupting the interior of said intermediate housing, said sector having surfaces for directing full 360° flow of said oil circuit throughout the hollow interior of said intermediate housing, b. means defining an oil flow circuit effective to direct oil received from the motion of said rotors into and through said access openings of said intermediate housing in a rotary spiraling path, and c. bipartite bearing means secured together as a unit and attached to said sector, said bearing means being spaced from said access openings but providing support for said eccentric shaft extending therethrough, said bearing means being located and supported by said sector in a manner to continue the full 360° flow of said oil circuit about the bearing as well as the hollow interior of said intermediate housing.

2. The combination as in claim 1, in which the sector occupies an arc about said eccentric shaft no greater than 100°.

3. In a multi-rotor rotary internal combustion engine, the engine having at least two rotor housings and an intermediate housing all in adjacent aligned relationship, an eccentric shaft extending through each of said housings with rotors supported thereon for planetary movement within each of said rotor housings, the combination comprising:

a. an intermediate housing having at least a peripheral end wall and side walls defining a hollow interior, said walls having access openings through which said shaft extends, an integral crescent mounting sector extending between opposite side walls and interrupting the interior of said intermediate housing, said sector having surfaces for directing full 360°F flow of said oil circuit throughout the hollow interior of said intermediate housing, b. means defining an oil flow circuit effective to direct oil received from the motion of said rotors into and through said access openings of said intermediate housing in a rotary spiraling path, and c. bipartite bearing means secured together as a unit and attached to said sector, said bearing means being spaced from said access openings but providing support for said eccentric shaft extending therethrough, said bearing means being located and supported by said sector in a manner to continue the full 360° flow of said oil circuit about the bearing as well as the hollow interior of said intermediate housing, said sector containing an oil passage extending arcuately therethrough to connect the uninterrupted hollow portion of said intermediate housing for promoting said full 360° circular flow thereabout, said oil flow flooding the exterior of said bearing means.

4. In a multi-rotor rotary internal combustion engine, the engine having at least two rotor housings and an intermediate housing all in adjacent aligned relationship, an eccentric shaft extending through each of said housings with rotors supported thereon for planetary movement within each of said rotor housings, the combination comprising:

a. an intermediate housing having at least a peripheral end wall and side walls defining a hollow interior, said walls having access openings through which said shaft extends, an integral crescent mounting sector extending between opposite side walls and interrupting the interior of said intermediate housing, said sector having surfaces for directing full 360° flow of said oil circuit throughout the hollow interior of said intermediate housing, b. means defining an oil flow circuit effective to direct oil received from the motion of said rotors into and through said access openings of said intermediate housing in a rotary spiraling path, and c. bipartite bearing means secured together as a unit and attached to said sector, said bearing means being spaced from said access openings but providing support for said eccentric shaft extending therethrough, said bearing means being located and supported by said sector in a manner to continue the full 360° flow of said oil circuit about the bearing as well as the hollow interior of said intermediate housing, said bearing means having first and second portions each having identical radially inner surfaces but different radially outer surfaces, the portion having the outer surface with the large radius being in intimate engagement with said sector along the outer surface thereof.

* * * * *